US005425477A

United States Patent [19]

Montaner et al.

[11] Patent Number: 5,425,477

[45] Date of Patent: Jun. 20, 1995

[54] PUMP SPRAYER WITH STATIONARY DISCHARGE

[75] Inventors: Pedro P. Montaner, Esplugues De Llobregat; Victor R. Turró, Barcelona, both of Spain

[73] Assignee: Monturas, S.A., Barcelona, Spain

[21] Appl. No.: 267,513

[22] Filed: Jun. 29, 1994

[51] Int. Cl.[6] ..... B67D 5/42

[52] U.S. Cl. ..... 222/383.1

[58] Field of Search ..... 222/336, 339, 382, 383, 222/321, 385

[56] References Cited

U.S. PATENT DOCUMENTS

| | | | |
|---|---|---|---|
| 4,051,983 | 10/1977 | Anderson | 222/321 |
| 4,596,344 | 6/1986 | Corsette | 222/383 X |
| 4,691,849 | 9/1987 | Tada | 222/383 X |
| 4,728,009 | 3/1988 | Schmidt | 222/383 X |
| 4,815,663 | 3/1989 | Tada | 222/383 X |
| 4,923,094 | 5/1990 | O'Neill | 222/383 X |
| 4,941,595 | 7/1990 | Montaner et al. | 222/321 |
| 4,953,791 | 9/1990 | Tada | 222/383 X |
| 4,982,900 | 1/1991 | Blake | 222/383 X |
| 5,064,105 | 11/1991 | Montaner | 222/321 |
| 5,222,637 | 6/1993 | Giuffredi | 222/383 X |
| 5,244,126 | 9/1993 | Geier | 222/383 |
| 5,299,717 | 4/1994 | Geier | 222/383 X |

FOREIGN PATENT DOCUMENTS

| | | | |
|---|---|---|---|
| 0286925 | 10/1988 | European Pat. Off. | 222/383 |
| 5-229577 | 9/1993 | Japan | 222/383 |

*Primary Examiner*—Andres Kashnikow
*Assistant Examiner*—Kenneth Bomberg
*Attorney, Agent, or Firm*—Watson, Cole, Grindle & Watson

[57] ABSTRACT

A precompression pump sprayer has a stationary discharge and a reciprocable pump cylinder which squeezes the air out of the pump chamber to facilitate priming as the cylinder is plunged relative to a piston shifted by the plunger to open the discharge during priming. Once primed the piston is shifted to open the discharge upon a build up of pressure during plunger reciprocation. A container vent is controlled by operation of the plunger.

17 Claims, 3 Drawing Sheets

PUMP SPRAYER WITH STATIONARY DISCHARGE

RELATED APPLICATION

This application relates to our application Serial No. 08/267,512 filed on even date herewith, entitled Pump Sprayer With Stationary Discharge, and commonly owned herewith.

BACKGROUND OF THE INVENTION

This invention relates generally to a precompression pump sprayer wherein spray discharge is valve controlled in dependence upon a build up of pressure in the pump chamber. More particularly, the pump sprayer of the invention has a stationary discharge orifice and a pump priming feature according to which unwanted air is expelled from the pump chamber through the discharge. And, the present pump sprayer has a positive container vent valving feature in which the vent valve is controlled upon impact by the plunger during plunger actuation.

Precompression pump sprayers of the general class to which the present invention is directed are known to operate in response to a build up of pressure in the pump chamber to effect discharge valve opening, the discharge valve being closed by a return spring when the internal pressure is overcome by the force of the spring. A separate return spring can be provided for that member carrying the discharge valve, in addition to another spring provided for returning the plunger to its upstroke or inactive position. The subatmospheric pressure in the pump chamber effected during the plunger upstroke causes product to be suctioned into the chamber.

U.S. Pat. No. 4,941,595 discloses a pump sprayer having such separate springs enabling the discharge valving to be tailored to products of diverse viscosities allowing for different recovery speeds or conditions and permitting the degree of precompression to be adjusted separately. The present pump sprayer likewise has such separate return springs—one for returning the discharge valve and the other for returning the pump plunger towards its upstroke position.

The need arises to provide a precompression pump sprayer having a fixed discharge orifice such that during pumping the spray orifice remains stationary enabling the user to concentrate the discharged product toward a fixed target unlike that of many pump sprayers in which the discharge orifice reciprocates with plunger reciprocation.

It is also well known that any air within the pump chamber of any pump sprayer must be evacuated before the pump sprayer is able to dispense liquid product. The air initially within the pump chamber is merely elastically compressed on the downward plunger stroke, without attaining a sufficiently high pressure to shift the discharge valve open as intended for such pump operation. Thus, when the plunger is released, the air decompresses and a volume of liquid only in proportion to the small amount of air that has been released is suctioned into the chamber. It may therefore become necessary to actuate the plunger several times to achieve pump priming.

A wide variety of pump priming approaches have been taken for evacuating the unwanted air from the pump chamber; for example, downwardly through the dip tube and into the container, as disclosed in U.S. Pat. No. 4,051,983; or by directing the air upwardly and around the pump piston and into the container through a side port located in the pump cylinder wall and/or outwardly to the atmosphere, as disclosed in U.S. Pat. No. 5,064,105.

As an alternative, it is desirable for the air to be evacuated from the pump chamber through the discharge such that any product mixed with air exits the pump through the established discharge path.

It is further known to provide the pump sprayer package with some type of container vent for admitting air into the container to replace the volume of liquid dispensed to avoid hydraulic lock and container collapse. Passive systems have been developed such as those having a resilient flap valve covering the vent port and opening in response to a differential pressure acting on opposite sides of the flap. Active vent systems have been developed providing for the uncovering of the vent port during the pumping operation by mechanically pushing the vent valve open utilizing some element of the pump structure. U.S. Pat. No. 5,244,126 discloses an example of such an active vent valving system for a trigger sprayer.

SUMMARY OF THE INVENTION

An object of the present invention is to provide a pump sprayer having a fixed discharge and suitable for a wide range of liquid viscosities and also for a wide range of precompression values by the provision of separate return springs for the discharge valve member and for the pump plunger.

The pump plunger of the present sprayer forms a reciprocable pump cylinder within which a member forming a pump piston is located for sliding sealing movement, the member having a discharge valve at its one end. During the pump priming operation, the plunger engages the piston at the end of the plunger downstroke for shifting the piston and its discharge valve away from a fixed discharge valve seat for purging the pump chamber of air through the discharge. And, the plunger impacts against a container vent valve at or near the end of the plunger downstroke for controlling the venting of air into the container during the pumping operation.

Other objects, advantages and novel features of the invention will become more apparent from the following detailed description of the invention when taken in conjunction with the accompanying drawings.

DESCRIPTION OF THE PREFERRED EMBODIMENT

Figure 5:
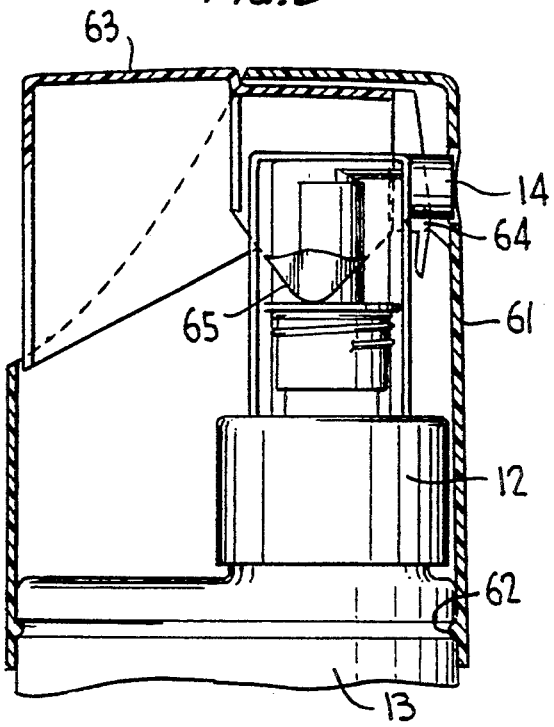
FIG. 5 is a side elevational view, at a reduced scale, of the FIG. 1 sprayer mounted on a container partly shown and illustrating in section a shroud cover and a plunger cap for activating the plunger.
Figure 7:
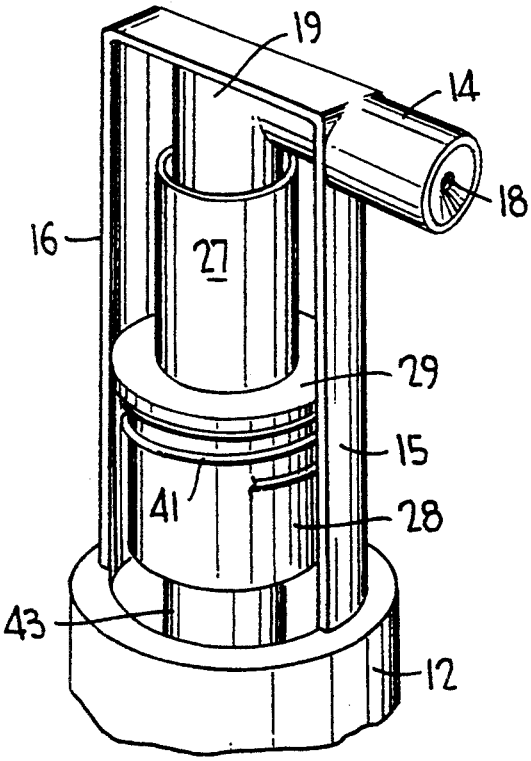
FIG. 7 is a perspective view of the FIG. 1 pump sprayer of the invention.
Figure 6:
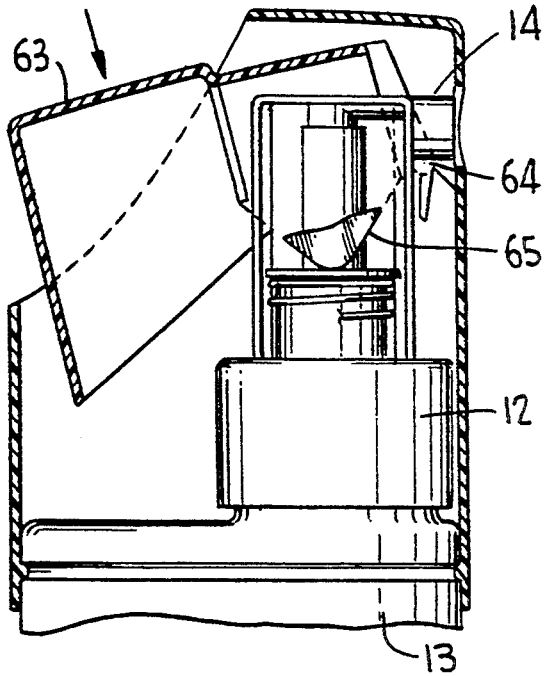
FIG. 6 is a view similar to FIG. 5 showing the plunger cap depressed for activating the plunger.

Turning now to the drawings wherein like reference characters refer to like and corresponding parts throughout the several views, one embodiment of the pump sprayer according to the invention is generally designated 10 in FIGS. 1, 2 and 5–7 and includes a pump housing 11 having an internally threaded closure 12 for thread mounting the pump sprayer to the neck of a container 13 partially shown in FIGS. 5, 6.

Held at a fixed distance above the closure is a spray nozzle assembly 14 supported by a pair of opposed support legs 15, 16, the nozzle assembly having a spray cup 17 containing a discharge orifice 18 through which product is dispensed in the form of a spray.

The nozzle assembly includes a depending sleeve 19 supporting a hollow, fixed discharge valve seat member 21 having a passage 22 in communication with a passage 23 formed by a tube 20 of the housing to thereby form a discharge passage terminating in orifice 18. Member 21 has a depending, annular, outwardly conical lip seal 24, and a conical valve seat 25.

A reciprocable pump plunger 26 is mounted within the pump housing, the plunger having a cylindrical upstanding sleeve 27 in sliding sealing engagement with fixed lip seal 24.

The plunger further includes a depending circular cylinder 28 defining a pump cylinder, and a transversely extending annular flange 29 forming an abutment or shoulder interconnecting sleeve 27 and cylinder 28.

A disk-like insert member 31 is supported within the pump housing, the insert having a depending annular seal 32 designed to extend within the neck of container 13 when the pump sprayer is mounted thereon.

The insert has a depending sleeve 33 coaxial with the closure and forming an upper slightly enlarged section 34. The sleeve has a transverse wall 35 containing an inlet port 36, wall 35 having at its upper surface a conical inlet valve seat 37 supporting an inlet ball check valve 38. A valve cage (not shown) located above the check valve can be provided if desired. And, sleeve 33 supports a depending dip tube 39 which extends into the container through which product is suctioned as in the manner to be described hereinafter.

Figure 1:
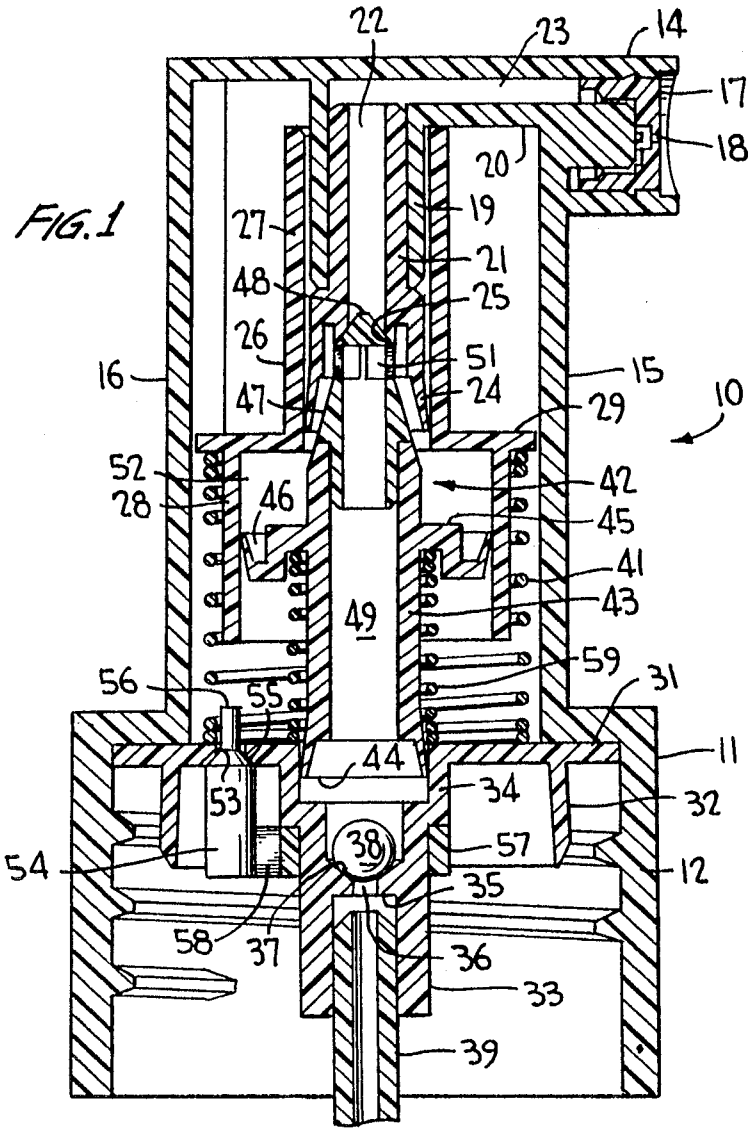
FIG. 1 is a vertical sectional view of one embodiment of the pump sprayer according to the invention shown in its inactive position.

First spring means 41, which may be in the form of a coil spring, is located within the pump housing externally of cylinder 28 and extends between the upper surface of insert 31 and the undersurface of flange 29. Spring means 41 resiliently urges the plunger to its inactive position of FIG. 1 shown at the end of the plunger upstroke position at which sleeve 27 of the plunger abuts against the underside of tube 20.

A member 42 is mounted for sliding sealing movement within the plunger, the member comprising a hollow sleeve 43 having an outwardly conical lip seal 44 at its lower end in sliding sealing engagement with the inner wall of section 34. And, the sleeve has a transversely extending annular flange 45 terminating in an annular, conical, upwardly directed lip seal 46 in sliding sealing engagement with the inner wall of cylinder 28. The sleeve has affixed to its upper end a discharge valve member 47 in the form of a poppet valve having a conical head 48 adapted to be seated against discharge valve seat 25 in the inactive position of the pump shown in FIG. 1. Valve member 47 is hollow forming together with hollow sleeve 43 an inlet passage 49 terminating in openings 51 formed in member 47 below its head 48.

Flange 45 of sleeve 43 forms together with its seal 46 a piston which together with pump cylinder 28 defines a variable volume pump chamber 52. Inlet passage 49 communicates with pump chamber 52 as does discharge passage 22, 23 via the discharge valve.

Insert 31 has a container vent port 53 with a conical downwardly directed valve seat, the port opening into the container interior. The port is valved closed by the provision of a vent valve 54 having an upper conical section 55 seated against the valve seat of port 53. And, valve 54 has a projection 56 extending through the vent port beyond the upper surface of insert 31 and in alignment with cylinder 28.

The vent valve is mounted to sleeve 33 by a collar 57 to which the vent valve is connected via one or more resilient legs 58.

Member 42 is spring biased to the inactive position of the pump shown in FIG. 1 by the provision of a second spring means 59, which may be in the form of a coil spring, mounted within the pump housing externally of sleeve 43 and extending between insert 31 and the underside of flange 45.

A shroud 61 may be provided for covering the pump sprayer, the shroud being snap fitted or otherwise connected to container 13 as at 62 (FIGS. 5, 6). The shroud has an opening 63 in its sidewall in alignment with spray nozzle 14, and a plunger cap 63 is hinged to the pump housing as at 64, the cap having a pair of depending cams 65 straddling opposite sides of sleeve 27 and bearing against the top side of flange 29.

Figure 2:
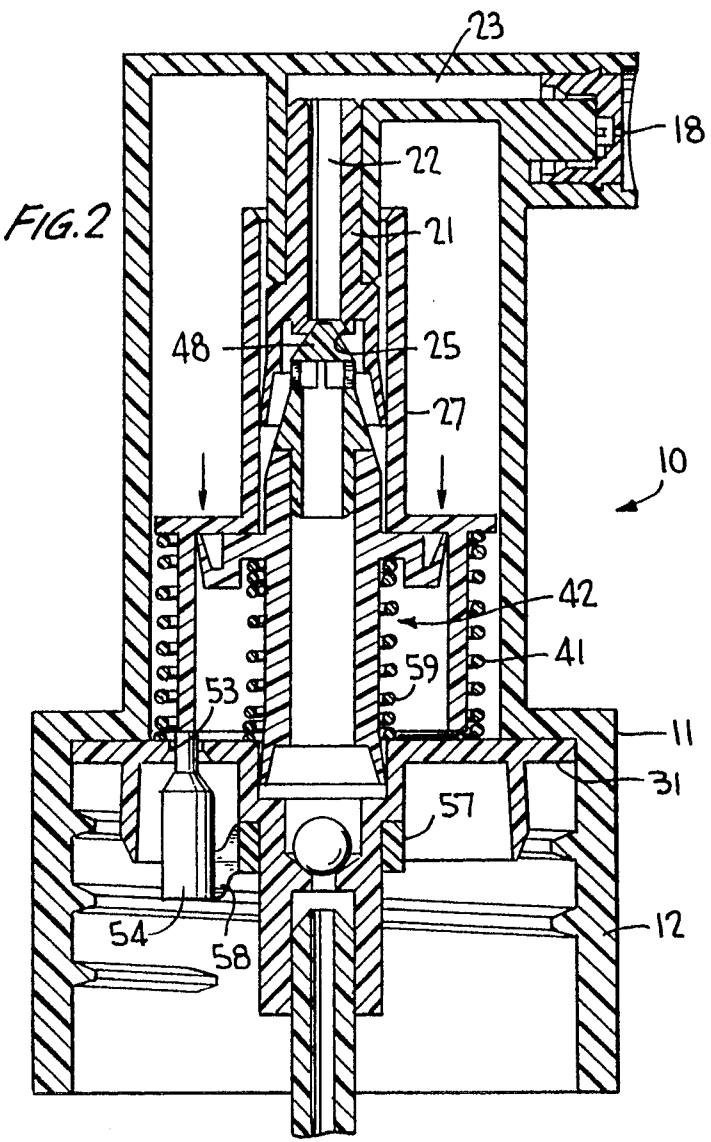
FIG. 2 is a view similar to FIG. 1 showing the plunger at or near the end of its downstroke position for shifting the discharge valve open during the priming operation.

In operation, upon depression of the plunger cap in the direction of the arrow of FIG. 6, plunger 26 is lowered as it guides along lip seal 24. Before initial dispensing and assuming pump chamber 52 to contain unwanted air, the plunger is downwardly stroked to compress the air within the pump chamber to at least some extent although the pressure may not increase sufficiently to cause the member 42 to shift downwardly to thereby open the discharge passage to expel the air. Thus, upon stroking the plunger until its flange 29 contacts flange 45 of the piston, and upon further downward depression of the plunger member 42 is lowered as it is guided along the wall of section 34 to thereby shift valve head 48 away from valve seat 25 to thereby open the discharge permitting the air to be expelled from pump chamber 52 under pressure through discharge passage 22, 23 and out through orifice 18. FIG. 2 shows the plunger depressed and member 42 shifted to open the discharge during the priming operation. The unwanted air is effectively squeezed out of the pump chamber as flanges 29 and 45 interengage and as the nose of member 42 substantially occupies the space within sleeve 27 below member 21.

Upon release of the finger pressure applied to the plunger cap, the plunger is returned toward its inactive position of FIG. 1 under the action of its spring 41 whereupon spring 59 returns member 42 to its position seated against the discharge valve seat such that a subatmospheric pressure is created in chamber 52 causing liquid product to be suctioned from the container through dip tube 39, unseating ball check valve 38, and filling the pump chamber as the product flows through inlet passage 49 and openings 51 into the pump chamber. One or more pressure strokes to fully achieve pump priming may be required until the pump chamber is completely evacuated of air. Once primed, depression of the plunger causes a build up of pressure within pump chamber 52 which pressure forces member 42 to shift downwardly against the force of its spring 59 to thereby open the discharge permitting product to be discharged under pressure through orifice 18. Near the end of the plunger downstroke, the lower edge of cylinder 28 impacts against projection 56 of vent valve 54 to thereby cause the vent valve to unseat under the action of its spring legs 58, as shown in FIG. 2 to thereby admit air into the container to replace the liquid dispensed to avoid hydraulic lock and container collapse on the ensuing upstroke of the plunger pump chamber 52 becomes sub-atmospheric to thereby suction product from the container into chamber 52 via the inlet passage.

During plunger depression, cams 65 of plunger cap 63 cam along the upper surface of flange 29 from the position of FIG. 5 to that shown in FIG. 6 to transmit the depression of the plunger cap to the plunger.

Figure 4:
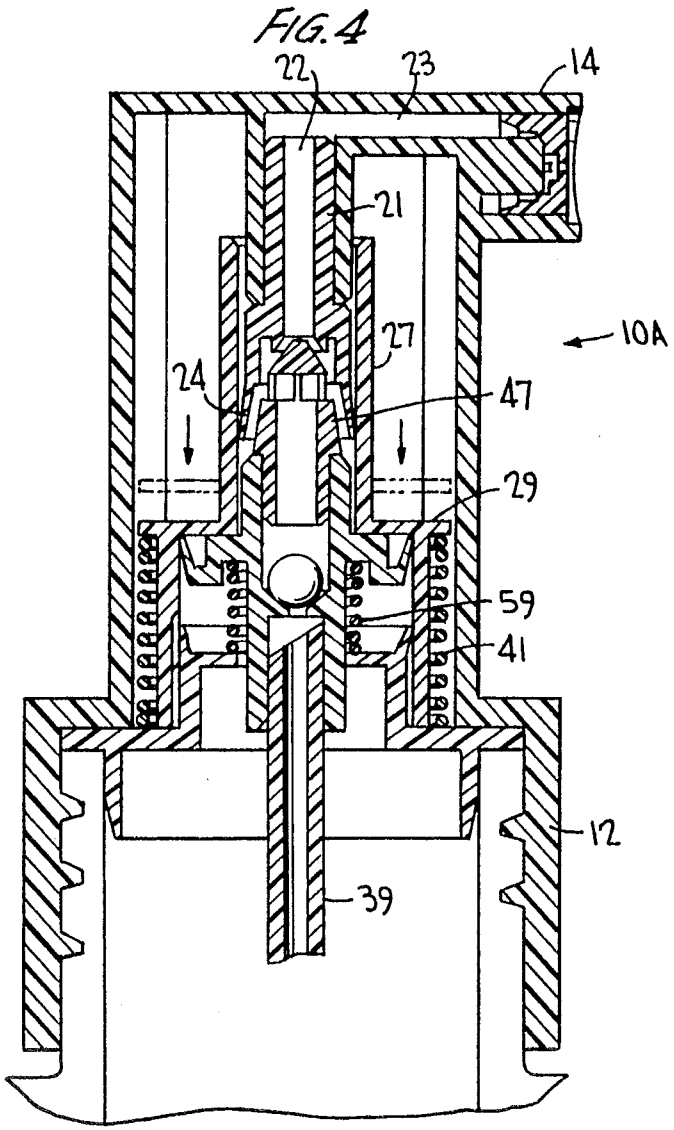
FIG. 4 is a view similar to FIG. 3 showing the plunger at the end of its downstroke at which the discharge valve is shifted open during the priming operation.
Figure 3:
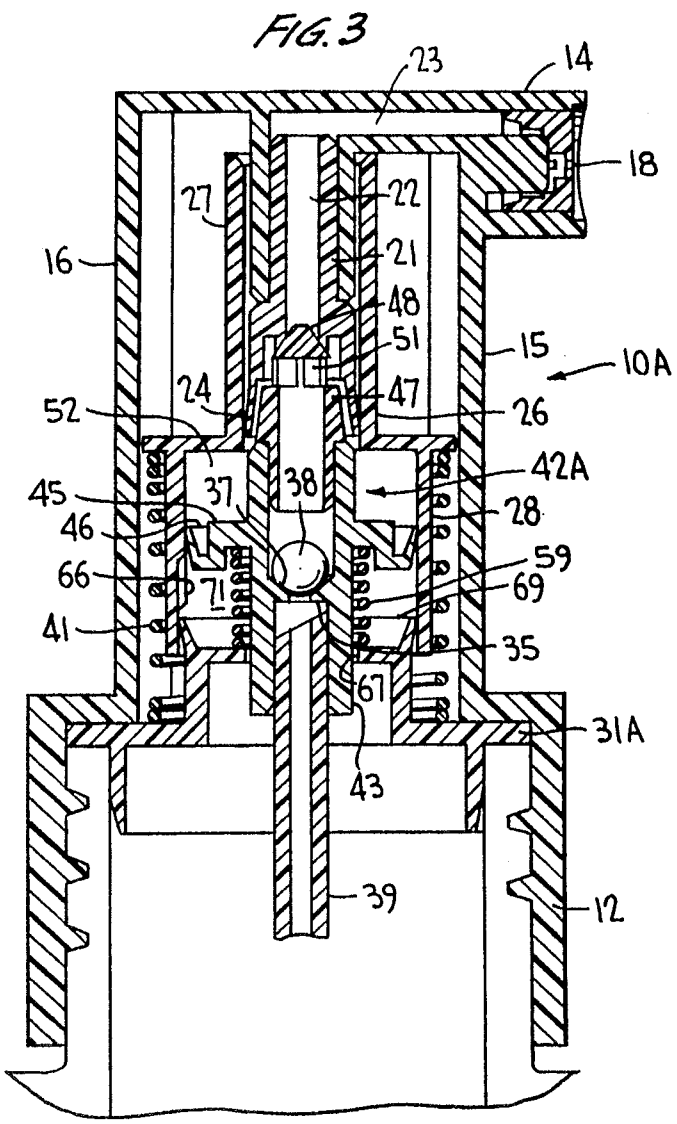
FIG. 3 is a vertical sectional view of another embodiment of the pump sprayer according to the invention shown with the plunger in its inactive position.

Another embodiment of the pump sprayer according to the invention is designated 10A in FIGS. 3 and 4, and is structured similar to that of pump sprayer 10 of FIGS. 1 and 2. Thus, like parts will be designated by like reference numerals.

Plunger 26 is essentially the same as in FIG. 1 except that it includes a vertical vent rib 66 located in a vent chamber 71 defined between the upper end of insert 31A and flange 45.

Member 42A mounted for sliding movement within cylinder 28 has its discharge valve more closely contoured to that of the inner contour of valve member 21. And, member 42A supports wall 35 forming inlet valve seat 37 on which inlet ball check 38 is supported. And, member 42A supports dip tube 39. Sleeve 43 of member 42A extends through a central opening 67 located in insert 31A. The outer diameter of sleeve 43 is slightly less than the size of opening 67 to thereby form a gap 68 through which air is vented into the container.

And, insert 31A has an upstanding, outwardly directed conical, and resiliently deformable lip seal 69 in sliding sealing engagement with the inner wall of cylinder 28.

Pump sprayer 10A of FIGS. 3, 4 operates the same as described with reference to FIGS. 1 and 2 except for its vent valving function. Thus, at or near the end of the plunger downstroke, rib 66 contacts lip seal 69 to thereby deform the seal permitting atmospheric air to pass by the seal and into the container through gap 68.

What is claimed is:

1. A pump sprayer comprising; a pump housing including a coaxial piston and cylinder assembly relatively reciprocable to define a variable volume pump chamber, a valve controlled fluid inlet passage leading into said chamber for communication with a source of liquid product to be dispensed, and a valve controlled fluid discharge passage leading away from said chamber, the improvement wherein:

said discharge passage is stationary and includes a valve seat member fixed to said housing;

said assembly comprising a spring biased reciprocable plunger in sliding sealing engagement with said valve seat member, said plunger including a pump cylinder;

an insert mounted within said housing;

said assembly further comprising a spring biased piston in sealing engagement with said insert, said piston having a free end in engagement with said valve seat member in a discharge closed position, and said piston being mounted to slide within said cylinder between said closed position and a discharge open position in which said free end disengages said valve seat member.

2. The pump sprayer according to claim 1, wherein said piston comprises a hollow stem forming said inlet passage.

3. The pump sprayer according to claim 1, wherein said plunger has an upper small diameter sleeve in engagement with said valve seat member, and a lower large diameter cylinder which comprises said pump cylinder, and said plunger having a shoulder formed between said upper sleeve and said lower cylinder.

4. The pump sprayer according to claim 3, wherein a plunger cap is hingedly mounted on said housing, said cap having cam means bearing against said shoulder for transmitting to said plunger an external finger force applied to said cap.

5. The pump sprayer according to claim 4, wherein a shroud covers said housing and has an opening in alignment with an end of said discharge passage, said shroud having a cutout through which said plunger cap extends.

6. The pump sprayer according to claim 3, wherein said piston comprises a hollow stem forming said inlet passage, said stem having a laterally extending flange spaced a predetermined distance from said shoulder for engagement by said shoulder during a downward stroke of said plunger for sliding said piston to said discharge open position to assist in priming.

7. A pump sprayer mountable on a container of product to be dispersed, comprising:

a pump housing;

a plunger reciprocable within said housing between inactive and downstroke positions;

a pump piston mounted to slide within said plunger to therewith define a variable volume pump chamber;

an insert mounted within said housing;

said housing having a fixed discharge passage extending from said chamber, said discharge passage containing a fixed valve seat member;

said piston having an inlet passage extending into said chamber, and said piston having an end in contact with said valve seat member in said inactive position;

an inlet check valve for controlling the flow of product through said inlet passage;

a first spring urging said plunger toward said inactive position;

a second spring urging said piston end toward said valve seat member;

said plunger having an abutment wall engageable with a laterally extending flange provided on said piston for shifting said piston end out of contact with said valve seat member to open said discharge passage to effect pump priming.

8. The pump sprayer according to claim 7, wherein said insert supports said inlet check valve.

9. The pump sprayer according to claim 7, wherein said insert has a container vent port normally closed by a valve member carried by said insert, said valve member being aligned with said plunger which acts on said valve member during plunger movement to open said vent port.

10. The pump sprayer according to claim 7, wherein said piston supports said inlet check valve.

11. The pump sprayer according to claim 10, wherein said piston is arranged to slide through a central opening provided in said insert and forming an annular vent passage, said piston flange being spaced from said insert to form a vent chamber, and means within said vent chamber for opening said vent passage to the atmosphere during movement of the plunger toward the downstroke position.

12. The pump sprayer according to claim 11, wherein said means comprises a deformable vent seal on said insert and a rib on said plunger.

13. The pump sprayer according to claim 7, wherein a plunger cap is hingedly mounted on said housing, said cap having cam means bearing against said abutment wall for transmitting to said plunger an external finger force applied to said cap.

14. The pump sprayer according to claim 13, wherein a shroud covers said housing and has an opening in alignment with an end of said discharge passage, said shroud having a cutout through which said plunger cap extends.

15. A pump sprayer mountable on a container of liquid product to be dispensed, comprising:

a pump housing;

a pump cylinder mounted within said housing for reciprocation between inactive and downstroke positions;

a pump piston mounted for sliding movement within said cylinder and therewith defining a variable volume pump chamber;

a fixed discharge passage extending from said chamber and being valve controlled by movement of one ed of said piston;

a container vent controlled by movement of said cylinder to admit air into the container during pump operation;

a spring biased valve member normally closing said vent and being impacted by said cylinder during its downstroke movement to cause the vent to open.

16. The pump sprayer according to claim 15, wherein said container vent is located in an insert mounted within said housing, said valve member being carried by said insert.

17. The pump sprayer according to claim 16, wherein said valve member has a probe extending through said vent in alignment with a free edge of said cylinder.

* * * * *